US010389077B2

(12) United States Patent
Zimmerhaeckel et al.

(10) Patent No.: US 10,389,077 B2
(45) Date of Patent: Aug. 20, 2019

(54) HF COAXIAL CABLE WITH ANGULAR PLUG CONNECTION

(71) Applicant: Spinner GmbH, Westerham (DE)

(72) Inventors: Bend Zimmerhaeckel, Glashütte (DE); Ingolf Fischer, Liebenau (DE); Falk Mutze, Liebenau (DE)

(73) Assignee: Spinner GmbH, Westerham (DE)

( * ) Notice: Subject to any disclaimer, the term of this patent is extended or adjusted under 35 U.S.C. 154(b) by 0 days.

(21) Appl. No.: 16/190,500

(22) Filed: Nov. 14, 2018

(65) Prior Publication Data

US 2019/0081448 A1 Mar. 14, 2019

Related U.S. Application Data

(60) Continuation of application No. 15/220,796, filed on Jul. 27, 2016, now abandoned, which is a division of application No. 14/415,823, filed as application No. PCT/EP2013/002153 on Jul. 19, 2013, now Pat. No. 9,748,711.

(30) Foreign Application Priority Data

Jul. 20, 2012 (DE) ..... 10 2012 014 425

(51) Int. Cl.
*H01R 43/28* (2006.01)
*H01R 24/56* (2011.01)

(52) U.S. Cl.
CPC ..... *H01R 43/28* (2013.01); *H01R 24/564* (2013.01)

(58) Field of Classification Search
CPC ..... H01R 9/05; H01R 13/646; H01R 24/564; H01R 24/545; H01B 11/18
See application file for complete search history.

(56) References Cited

U.S. PATENT DOCUMENTS

| | | | | |
|---|---|---|---|---|
| 3,480,722 | A | 11/1969 | Van Horssen et al. | |
| 7,025,246 | B2 | 4/2006 | Wild et al. | |
| 7,419,403 | B1 * | 9/2008 | Paynter | H01R 9/0521 439/578 |
| 8,992,250 | B1 * | 3/2015 | Hosler, Sr. | H01R 13/622 439/322 |

(Continued)

FOREIGN PATENT DOCUMENTS

| | | |
|---|---|---|
| DE | 1 801 189 A1 | 6/1969 |
| DE | 30 48 781 A1 | 9/1981 |

(Continued)

*Primary Examiner* — Timothy J Thompson
*Assistant Examiner* — Amol H Patel
(74) *Attorney, Agent, or Firm* — Fitch, Even, Tabin & Flannery LLP

(57) ABSTRACT

The invention is a HF coaxial cable that comprises a cable inner conductor and a cable outer conductor, as well as an angular plug connection at least one of its two cable ends. The cable is straight HF corrugated cable including a cable outer conductor, a trimmed HF corrugated cable end, straight plug connector connected to the prepared cable end; and a cold forming region of the HF corrugated cable which is bent with a force directed transversely to a longitudinal extension of the HF corrugated cable and a tensile force applied to the cable. The HF corrugated cable is permanently bend, to have a bending radius which alters line impedance to be a maximum of 1 ohm.

6 Claims, 7 Drawing Sheets

(56) References Cited

U.S. PATENT DOCUMENTS

| | | | | |
|---|---|---|---|---|
| 9,054,471 | B2 * | 6/2015 | Hosier, Sr. ..... | H01R 24/542 |
| 9,608,344 | B2 * | 3/2017 | Zhang ..... | H01R 9/0503 |
| 2004/0094605 | A1 | 5/2004 | Wild et al. | |
| 2006/0113101 | A1 | 6/2006 | Wild et al. | |
| 2016/0111798 | A1 * | 4/2016 | Wu ..... | H01R 4/183<br>439/391 |

FOREIGN PATENT DOCUMENTS

| | | |
|---|---|---|
| DE | 38 36 141 A1 | 4/1990 |
| DE | 198 54 503 C1 | 5/2001 |
| DE | 103 50 763 A1 | 6/2004 |
| FR | 2 503 942 A1 | 10/1982 |

* cited by examiner

HF COAXIAL CABLE WITH ANGULAR PLUG CONNECTION

CROSS REFERENCE TO RELATED APPLICATIONS

This application is a continuation of application Ser. No. 15/220,796 which is a divisional of application Ser. No. 14/148,823 which is U.S. Pat. No. 9,748,711 and which applications and patent are incorporated herein by reference in their entirety. Reference is also made to PCT/EP2013/002153, filed Jul. 19, 2013 and to DE 10 2012 014 425.3, filed Jul. 20, 2012, the complete disclosures of which are hereby incorporated herein by reference in their entirety for all purposes.

TECHNICAL FIELD

The invention relates to an HF coaxial cable that comprises a cable inner conductor and a cable outer conductor, as well as an angular plug connection at at least one of its two cable ends.

PRIOR ART

HF angular plug connections of the above type allow a substantially loss-free HF signal redirection, preferably by 90°, and are typically used for purposes of HF signal coupling into or HF signal coupling out of HF device components. Particularly advantageous is the only small overall height of such angular plug connections, which enables a reliable HF signal connection for the first time, principally in narrow installation spaces, as are often prevalent on the rear walls of devices.

An HF coaxial angular plug connector of the generic type is described in the published document DE 198 54 503 C1, which provides a plug connector inner conductor, which is centered by means of an insulating support of dielectric material within a metal housing, which at the same time constitutes the plug connector outer conductor. A receptacle opening for an HF coaxial cable assembled at the front is provided at right angles to a housing axis that can be allocated to the metallic housing. For the purpose of securely joining the cable inner and outer conductors to the corresponding inner and outer conductor regions provided on the housing side, an access opening that can be closed at the side on the metallic housing is provided, through which soldered connections between the respective inner and outer conductors have to be undertaken, but which are viewed as complicated installation steps and thus contribute a considerable portion of the production costs.

An angular plug connection for high-frequency coaxial cables is known from DE 38 36 141 A1, which can be realized with lower production costs owing to the simpler construction thereof. The known angular plug connection to this end provides a flexible HF coaxial cable. The cable outer conductor is a wire mesh and the assembled cable end thereof is connected to a specially shaped straight plug connector. The plug connector has a contact sleeve surrounding the cable outer conductor, which has a sleeve opening, which makes it possible to bend the sleeve region including the inner coaxial cable through 90°. The bending of the sleeve regions ensures that the cable inner conductor retains its insulation in the region of the angling. The radius of curvature of cable inner conductor and cable outer conductor is dimensioned such that the wave impedance of the coaxial cable remains constant, particularly in the region of the kink. For the purposes of plug stabilization, protection and also improved handling, the ready-installed plug is encapsulated with a corresponding plastic coating.

The coaxial cable described in the published document DE 103 50 763 A1 provides a similarly simple construction with an angular plug connection, in which the redirection through 90° for the HF signal line is realized by bending a flexible coaxial cable. In this case, the assembled coaxial cable end is connected to a straight plug connector, which is known per se. The HF coaxial cable set thereof, which protrudes directly out of the plug connector, has a 90° bend. A moulded part of a thermoplastic is used for maintaining the shape thereof. The flexible HF coaxial cable has an outer conductor formed from a metal mesh.

The published document DE 18 01 189 A discloses a right-angled coaxial-cable connector, with reduced electrical losses. Reference is expressly made to the fact that electrical losses increase in the case of deformations of a coaxial cable with radii that are too narrow. It is suggested to bend the coaxial cable in a gentle arc. A slot-shaped recess additionally is introduced in a plug housing part. Through the recess the cable is formed in the forming region into a gentle arc to the greatest extent possible.

The published document FR 2 503 942 A1 is concerned with the production of a bent semi-rigid cable, avoiding mechanical and electrical discontinuities in the outer conductor, which can occur in the form of microtears due to the deformation process, to the greatest extent possible. It is suggested to electrolytically coat the outer conductor after the bending of the semi-rigid cable, e.g. with a layer thickness of 2.2 mm, in order to improve the electrical properties.

Finally, the published document DE 30 48 781 A1 discloses a flexible coaxial cable with an outer-conductor mesh constructed as an outer conductor. It is suggested to remove the outer layer of the coaxial cable in the bending region, so that the outer conductor mesh is exposed. Subsequently, the coaxial cable is bent and the bend is fixed by a setting material. Solders or resin-based adhesives are preferred as setting material.

SUMMARY OF THE INVENTION

The invention is based on developing a HF coaxial cable, particularly in the form of a corrugated sheath cable, with a cable inner conductor and cable outer conductor and also an angular plug connection at at least one of the two cable ends thereof in such a manner that the production outlay should be reduced considerably, whereby the high-frequency signal transmission properties are improved significantly, particularly at high frequencies, for example greater than 4 GHz. It is necessary that the sizes, that is to say particularly the overall heights of hitherto-known angular plug connectors are not exceeded, but rather are reduced. It should be possible to implement all of the measures to be met for this using, in terms of process engineering, simple means, particularly of assembling factories. Also, the diversity of parts required to be stocked for producing the angular plug connection, the logistics and storage outlay should be reduced considerably.

A HF coaxial cable constructed according to the solution having the features of the preamble of Claim 1 is characterised by a conventional corrugated sheath cable, which is known per se, having a cable outer conductor constructed as a metal corrugated tube and a cable inner conductor, to which a line impedance $Z_k$ and also a minimum bending radius $r_{k,min}$, which is for the most part determined by the cable manufacturer, are allocated. A straight plug connector is attached at at least one cable end. For connection to the plug connector, the at least one cable end of the corrugated sheath cable is assembled, that is to say the cable inner conductor exposed at the end is joined with an inner conductor of the straight plug connector and the cable outer conductor is joined with an outer conductor of the straight plug connector. Directly or indirectly following the straight plug connector, the corrugated sheath cable has a bend that has a bending radius $r_\alpha$, which is significantly smaller than the minimum bending radius $r_{k,min}$ predetermined by the cable manufacturer. In accordance with the invention, significantly smaller means a bending radius $r_\alpha$, for which the following applies: $0.2\ r_{k,min} \leq r_\alpha \leq 0.9\ r_{k,min}$, preferably $0.3\ r_{k,min} \leq r_\alpha \leq 0.7\ r_{k,min}$, particularly preferably $0.4\ r_{k,min} r_\alpha \leq 0.6\ r_{k,min}$.

In addition, the bent corrugated sheath cable dimensioned according to the invention has a line impedance $Z_\alpha$, for which the following applies:

$$|Z_\alpha - Z_k| \leq 1\Omega$$

That is in spite of bending the corrugated sheath cable with a significantly smaller bending radius than that which is predetermined as the minimum bending radius by the manufacturer, the HF coaxial cable with angular plug connection according to the invention has HF transmission qualities, which correspond or at least substantially correspond to those of an undeformed corrugated sheath cable. The HF coaxial cable according to the invention is therefore characterized in particular by a bend with the bending radius $r_\alpha$, which is produced by cold forming the corrugated sheath cable with the introduction of a bending force transversely to the corrugated sheath cable and also a tensile force along the corrugated sheath cable. By means of the mutually adjusted introduction of force with reference to the bending and tensile forces, it is ensured that the corrugated sheath cable geometry, which is characteristic for a loss-free HF signal propagation along the corrugated sheath cable, is not or at least is not appreciably changed by the bending. The corrugated sheath geometry characteristic for the HF signal propagation is in particular understood to mean an electrically effective diameter of the corrugated sheath cable, which corresponds to half the sum of one maximum and minimum diameter in each case that can be allocated to the cable outer conductors, which are constructed in a corrugated manner. For an unhindered HF signal propagation along the corrugated sheath cable section bent according to the invention, the electrical diameter of the corrugated sheath cable deviates in the region of the bending radius $r_\alpha$ by less than 10% from the electrical diameter in the remaining, that is a non-bent or -shaped corrugated sheath cable region.

Due to the bending of the corrugated sheath cable according to the invention with the required bending radii far below the minimum bending radii specified by the manufacturer, although the concept according to the invention uses the known HF coaxial cable angular plug connections, in which the HF signal propagation direction at 90° is realized by bending a correspondingly flexibly configured coaxial cable. The concept according to the invention goes beyond in a targeted manner the technically acceptable use limits imposed by the manufacturer in the case of corrugated sheath cables with respect to not undershooting a predetermined minimum bending radii. The significant undershooting of the bending radius initially creates the prerequisite of creating compact overall heights for the construction of an angular plug connection based on a corrugated sheath cable, which has overall heights comparable with the overall heights of conventional angular plug connections. However, due to the use of corrugated sheath cables bent according to the invention, in contrast with conventional coaxial cables with angular plug connections, in addition to a simpler installation or production of the angular connection, explained hereinafter, significantly better signal transmission qualities result, particularly in the case of frequencies of greater than 4 GHz.

The HF coaxial cable with an angular plug connection according to the invention can fundamentally be realized with corrugated sheath cables of all standardized diameter classes from ⅛" to ⅝". Thus, for corrugated sheath cables with a nominal diameter of ⅛", a minimum bending radii $r_\alpha$ of 4 mm to 10 mm can be realized according to the invention with the minimum bending radius $r_{k,min}$ specified by the manufacturer typically being specified as 18 mm. In the case of ¼" corrugated sheath cables, minimum bending radii $r_\alpha$ of 5 mm to 15 mm can be realized with $r_{k,min}$ typically being 25 mm. For corrugated sheath cables with a nominal diameter of ⅜", a minimum bending radii $r_\alpha$ of 7 mm to 20 mm can be realized, for which a minimum bending radius $r_{k,min}$ of 25 mm being specified by the manufacturer. Finally, for ½" corrugated sheath cables, a minimum bending radii $r_\alpha$ between 9 and 25 mm can be realized with $r_{k,min}$ at 32 mm being specified by the manufacturer. All commercially available corrugated sheath cables are fundamentally suitable for realizing a HF coaxial cable with angular plug connector according to the invention which relates to standardized corrugated sheath cables, particularly also super-flexible corrugated sheath cables, which have a spiral-corrugated outer conductor contour that is with a pitch.

To produce the HF coaxial cable with angular plug connection according to the invention, at least one cable end needs to be assembled initially and the cable outer conductor and also the cable dielectric are trimmed with respect to the cable inner conductor. If present, the cable sheath protecting the HF corrugated sheath cable is likewise trimmed in certain areas.

In a next step, a straight plug connector is securely connected to the previously explained prepared cable end by joining the cable inner conductor to the inner conductor of the straight plug connector and the cable outer conductor to an outer conductor of the straight plug connector, preferably by soldering, crimping or similar joining methods. Of course, releasably secure joining techniques can also be used. For example, the cable inner conductor can be connected to a plug-side inner conductor structure by laminating or spring-loaded contacting. The installation outlay required for this is far lower compared to angular plug connectors composed of a plurality of components, as are known from the published document DE 198 54 503 C1 discussed above.

Subsequently, it is necessary to bend the corrugated sheath cable emanating from the plug connector in a straight line in one region which preferably directly follows the plug connector. The bending process takes place by means of cold forming under the action of a bending force directed transversely to the longitudinal extension of the HF corrugated sheath cable and a tensile force orientated longitudinally to the HF corrugated sheath cable, in such a manner that the corrugated sheath cable experiences a permanent bend with a bending radius $r_\alpha$, where $r_\alpha \leq r_{k,min}$, directly or indirectly following the straight plug connector. This bending alters the line impedance $Z_k$ of the straight-running, undeformed corrugated sheath cable by a maximum of 1 ohm, as a result of which the return loss $a_r$ of the conventional corrugated sheath cable can be changed as a function of the frequency by up to 2% due to the bend of the bending radius $r_\alpha$.

The tensile force additionally acting along the corrugated sheath cable as a function of the bending force acting on the corrugated sheath cable is chosen under the proviso of stretching the corrugation contour of the cable outer conductor facing radially inwards to the bending radius on the one hand, so that a direct mutual bearing of adjacent corrugated structure side faces is counteracted. But on the other hand, the formation of tears, owing to overextension or overstretching, on the outer conductor surface radially outwardly facing the bend is eliminated.

Optionally, the cold formed bending region of the corrugated sheath cable is provided with an envelope, which exerts both a protection and support function for the bent region of the HF corrugated sheath cable. The bent cable region with the plug connector connected thereto is advantageously inserted into a correspondingly prefabricated casting mould and in the context of a subsequent moulding process, provided with a corresponding envelope using a suitably chosen thermoplastic material. Depending on the functional demand, the bent corrugated sheath cable region can alternatively be protectively surrounded with a hot adhesive, a shrink-fit hose or a suitably constructed protective sleeve.

With the previously described method, HF angular plug connectors can be realized, which are characterized by the use according to the invention of a HF corrugated sheath cable whose bend according to the invention, which is created by cold forming, has a significantly smaller bending radius than the minimum bending radius permitted by the manufacturer in each case. Thus, for example, an angular plug connector constructed according to the invention using a ¼ corrugated sheath cable has an overall height of just approx. 40 mm. Although an overall height of this type can be realized with conventional angular plug connections, it cannot be realised using a conventional straight plug connection on a corrugated sheath cable, which would be bent minimally in accordance with manufacturer instructions and would furthermore permanently have HF transmission qualities that comply with the technical standard.

In another embodiment, the region of the cable is not bent directly following the straight plug connector along the corrugated sheath cable. Instead, the bend is rather in a suitable region, which lies spaced apart from the at least one plug connector attached to the cable at the end. Although the main aspect of the HF coaxial cable with angular plug connection according to the invention typically provides a bending angle β of 90° with a tolerance range of ±5°, i.e. $85° \leq \beta \leq 95°$, bends along the corrugated sheath cable are also conceivable with bending angles, β, which deviate therefrom, for example β=60°.

The dimensional shape of the angular plug connection and associated therewith the bending angle can be permanently fixed, for example by providing thermoplastically injection moulded geometries at the manufactured angular plug connection like webs, bulges, lobes, sieve-like structures. These geometries do not require additional effort and can be used for further functions like labels, attached caps, embedded functional parts etc.

The invention is A high-frequency (HF) coaxial corrugated cable comprising a plug connector located at at least one of two ends, a cable inner conductor, a dielectric layer surrounding and contacting the cable inner conductor and tubular metallic corrugated outer conductor surrounding and contacting the dielectric layer; a HF corrugated coaxial cable including a tubular metallic corrugated outer conductor which centrally surrounds the cable inner conductor and the dielectric layer, the HF corrugated coaxial cable having characteristic features including line impedance $Z_k$, and a minimum bending radius $r_{k,min}$ specified by a manufacturer; an end of the HF corrugated coaxial cable providing access to the cable inner conductor, the dielectric layer surrounding and contacting the inner cable conductor and the metallic outer conductor surrounding and contacting the dielectric layer; and wherein the plug connector is connected to one of the cable ends, the cable inner conductor being joined to an inner conductor of the plug connector and the cable metallic corrugated outer conductor is joined with an outer metallic conductor of the plug connector; and the HF corrugated coaxial cable includes a cold formed region and is attached to the plug connector or spaced from the plug connector with a permanent curved bend subtending an angle between 85° and 95° in the corrugated coaxial cable with a radius length $r_\alpha$ extending from a center point to the curved bend of the HF corrugated coaxial cable which provides the line impedance $Z_k\ r_{k,min}$ with a maximum of less than 1 ohm when $0.2\ r_{k,min}\ r_\alpha \leq 0.9\ r_{k,min}$.

Also, a plurality of bending regions can clearly be provided along a HF corrugated sheath cable, too, using the suggested cold forming method.

BRIEF DESCRIPTION OF THE DRAWINGS

The invention is described by way of example in the following without limitation of the general inventive idea on the basis of exemplary embodiments with reference to the drawings. In the figures.

DESCRIPTION OF THE PREFERRED EMBODIMENTS

Figure 1:
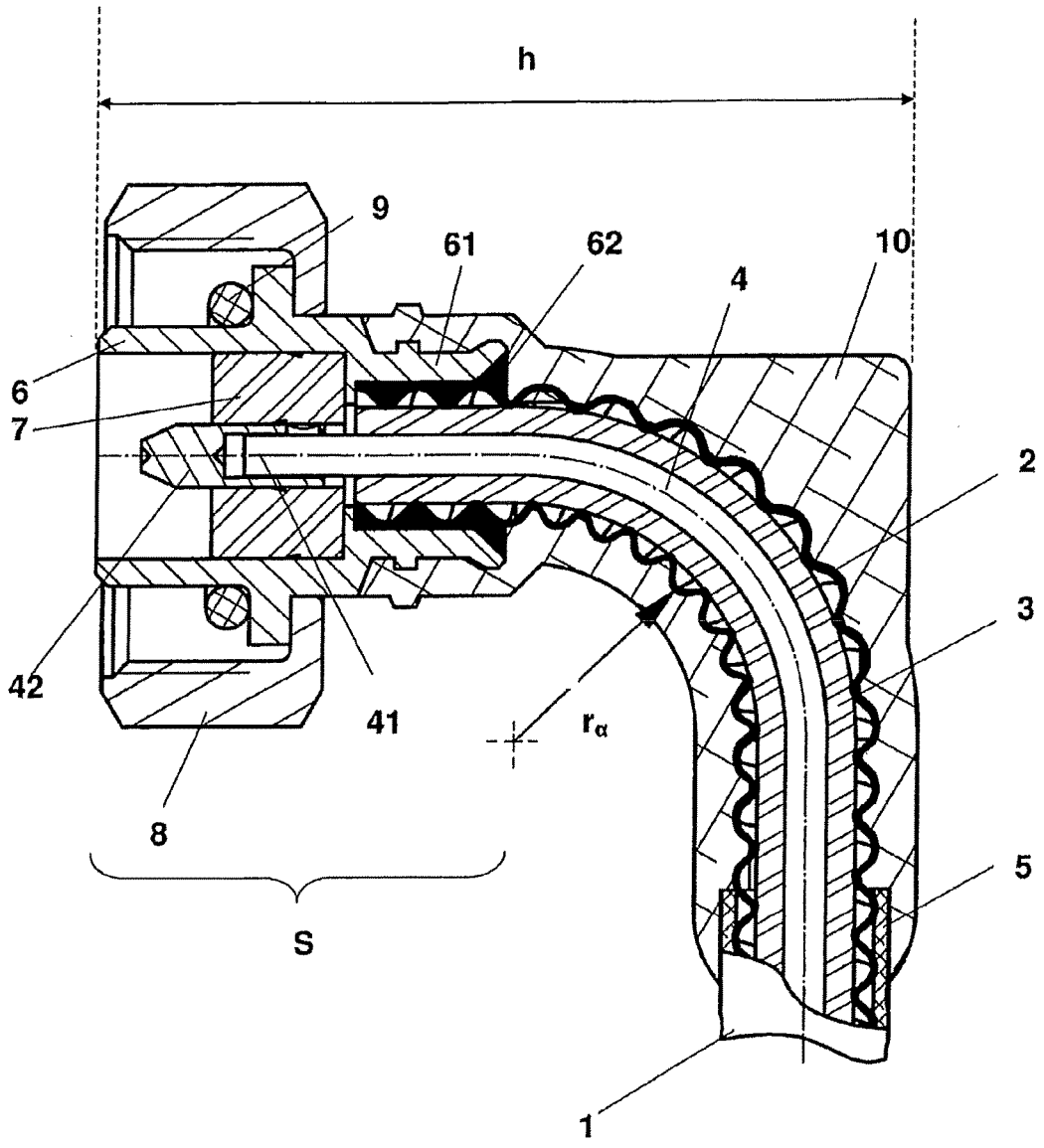
FIG. 1 shows a longitudinal section through an HF coaxial cable with an angular plug connection constructed according to the invention.

FIG. 1 shows a longitudinal sectional illustration for an HF coaxial cable with an angular plug connection constructed according to the invention. The HF coaxial cable used according to the invention constitutes a conventional corrugated sheath cable 1, which has a cable outer conductor 2, which is corrugated in a spirally undulated manner, and also a cable inner conductor 4, which is guided centrally to the cable outer conductor 2 inside a cable dielectric 3. The cable outer conductor 2 is typically encapsulated by a plastic envelope 5.

The cable end of the corrugated sheath cable 1 of FIG. 1 has a protruding end 41 of the cable inner conductor 4 opposite a trimmed cable dielectric 3 and a cable outer conductor 2. The end 41 of the cable inner conductor 4 leads into a receptacle opening inside an inner conductor 42 provided on the plug side which is gripped in a component 7 to provide electrical insulation with respect to a plug-side outer conductor 6. The end of the cable outer conductor 2 is surrounded on the outside by an accommodating sleeve 61 of the plug outer conductor 6, and is securely joined to the same, preferably by means of a solder connection 62. A union nut 8 is additionally attached externally on the plug outer conductor 6 such that it can move longitudinally and cannot be lost. The plug connector S, which is securely connected to the corrugated sheath cable 1 at the end in FIG. 1, constitutes a straight plug connector that is known per se. It is possible to use customary joining techniques that are simple to master for the attachment thereof on the prefabricated cable end of the corrugated sheath cable 1. In addition, an envelope 10 is provided around the bent region of the corrugated sheath cable 1, which is not covered with the cable covering 5. The envelope can preferably be produced by a thermoplastic forming process and in addition to it providing a mechanical support function, the thermoplastic also ensures a sealing and protecting function with respect to external influences.

The novelty of the angular plug connection illustrated in FIG. 1 on the one hand lies in the use of the corrugated sheath cable 1, on the assembled cable end of which a straight to which a conventional plug connector S is attached with the corrugated sheath cable 1 having a bend, having a uniform bending radius $r_\alpha$. The bending radius according to the invention is chosen to be significantly smaller than a minimum bending radius $r_{k,min}$ specified as a minimum by the manufacturer of the corrugated sheath cable 1. Only by significantly undershooting the minimum bending radius $r_{k,min}$ permitted by the manufacturer can an angular plug connection be achieved, with the overall height h corresponding to or undercutting the dimensions of known angular plug connections.

The actually achievable bending radius $r_\alpha$ is dimensioned on a circumferential contour facing the inward bend along the cable outer conductor 2, which comes into contact with a correspondingly fitted bending tool, as is also described below. Additional application-specific properties can be realized with the envelope.

The bending of the corrugated sheath cable 1 takes place in a cold forming process, which is performed with sufficient care to not impair the electrically effective diameter $d_e$. The electrically effective diameter de for a corrugated sheath cable 1, which has a decisive influence on the HF signal transmission along the corrugated sheath cable 1, is composed of half of the sum of the maximum and minimum diameter of the corrugated sheath cable 1 results from the corrugated cable outer conductor structure thereof.

Figure 2:
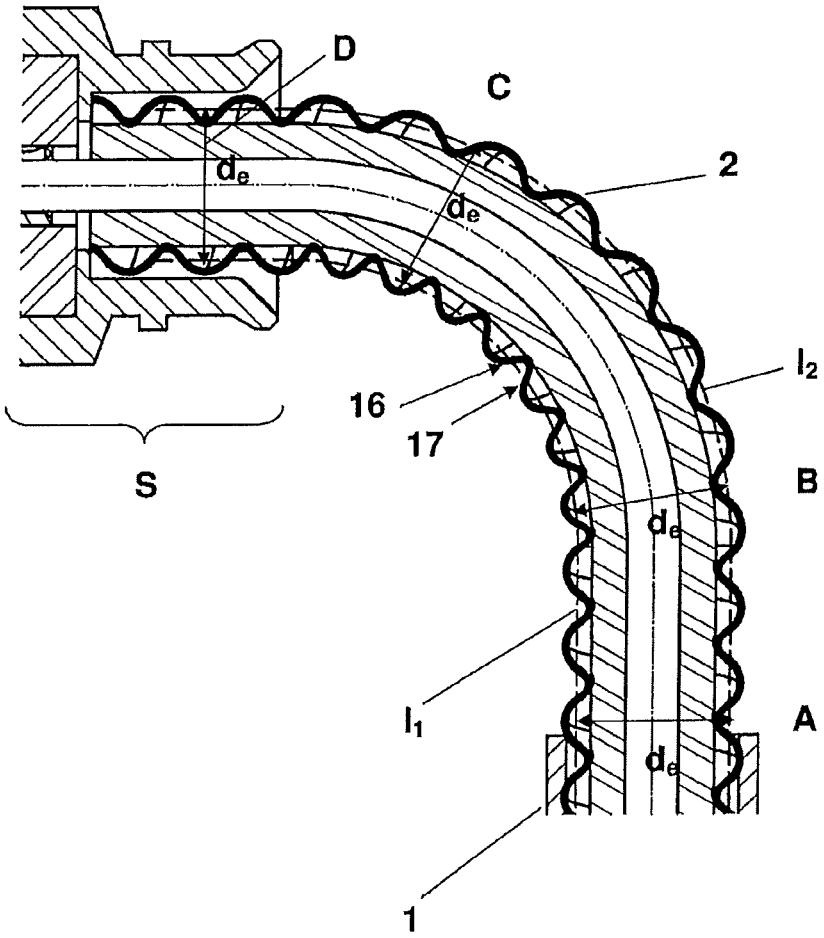
FIG. 2 shows a longitudinal section through a bent corrugated sheath cable for illustration of the electrical diameter.

The dielectric diameter $d_e$ is illustrated with two dashed lines $I_1$ and $I_2$ in FIG. 2 which is a longitudinal section of a bent corrugated sheath cable 1. The cable 1 is connected at one end to a straight plug connector S, which is explained in more detail in conjunction with FIG. 1. Both dashed lines $I_1$ and $I_2$ run centrally through the corrugated cross-sectional contour of the cable outer conductor 2. In order to retain the required unchanged HF transmission qualities along the corrugated sheath cable 1 in spite of significant undershooting of the minimum bending radius $r_{k,min}$ defined by the manufacturer, it is necessary to carry out the bending along the corrugated sheath cable 1 with unchanged dielectric diameter $d_e$. The electrically effective diameters $d_e$ at the representatively indicated cable points A, B, C, D are ideally identical. A tolerable deviation of the actual cable diameter at the points C, B compared to a non-bent cable region, for example A, D may be 10% at most.

Figure 3:
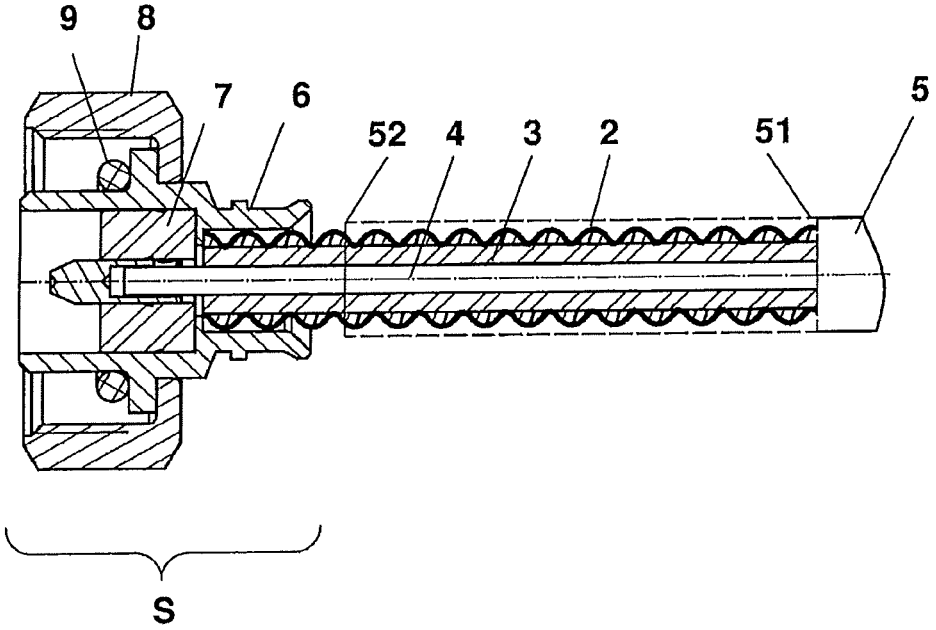
FIG. 3 shows a longitudinal section through a straight plug connector attached on the cable end of a corrugated sheath cable.

To produce the angular plug connection according to the invention, a straight end of a corrugated sheath cable 1 is prepared and provided by trimming the outer cable sheath 5 as far as the cable sheath end 51 of the cable outer conductor 2 and of the cable dielectric 3, as it were, with respect to the cable inner conductor 4 (cf. FIG. 3). It may only be mentioned for the sake of completeness that the cable sheath 5 is only shortened as far as the cable sheath end 52 if no subsequent bending of the cable sheath 1 takes place.

Subsequently, a conventional straight plug connector S can be joined to the assembled cable end, the plug inner conductor 42 being securely connected, for example soldered or crimped, to the exposed cable inner conductor 4. Subsequently, the plug outer conductor 6 is pushed on or alternatively screwed on and soldered, clamped, welded or otherwise securely connected to the cable outer conductor 2. In this case, the straight plug connector S can be completed in advance, for example using a union nut 8, an insulating component 7 or, if necessary, using a seal 9. Alternatively, the straight plug connector S can be a plug, as a coupler or in a hybrid manner.

Figure 4A:
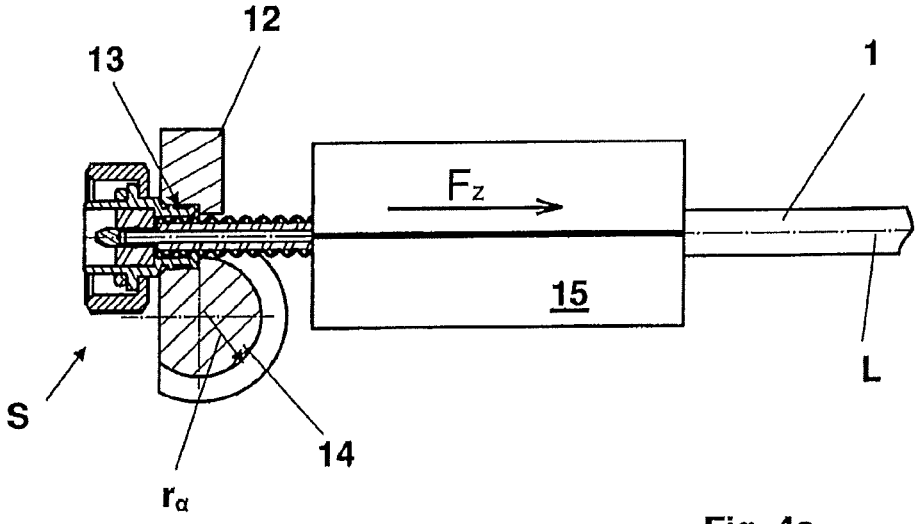
FIGS. 4*a-c* show a sequential image illustration for cold forming according to the invention of the corrugated sheath cable with straight plug connector.
Figure 4B:
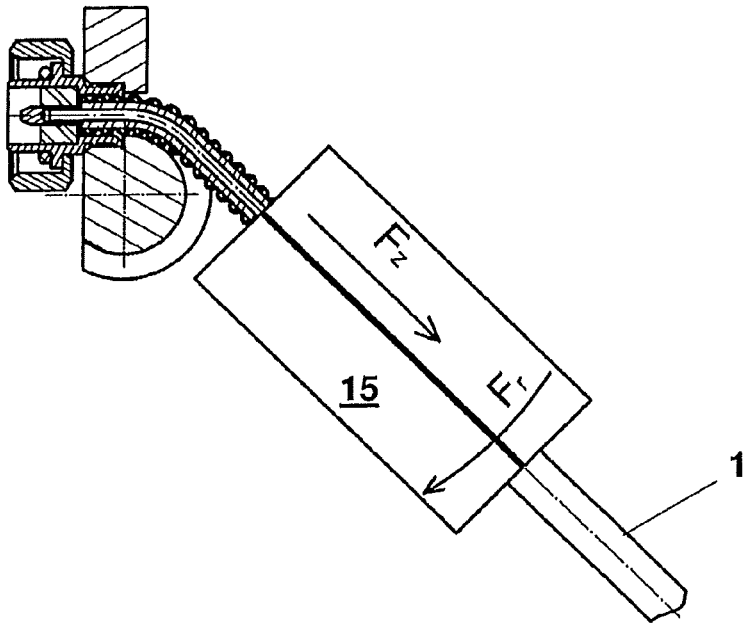

The cold-forming procedure takes place in the next step, which is explained with reference to the FIGS. 4*a* to *c* on the basis of a first exemplary embodiment. A retaining means 12 is illustrated in FIG. 4*a*, which has a receptacle opening 13, which is adapted in an oppositely contoured manner to a supporting section of the plug connection S, so that the straight plug connector S is releasably fixed in a secure manner relatively to the retaining means 12, which is attached in a stationary manner. A bending guide 14 adjoins the retaining means 12 on one side along the corrugated sheath cable 1, the bending contour of which bending guide corresponds to a predetermined bending radius $r_\alpha$. The corrugated sheath cable 1 is connected to a clamping and tensioning device 15 at a distance from the retaining means 12. The clamping and tensioning device creates both a tensile force $F_Z$ orientated longitudinally along the cable longitudinal extent L and a bending force $F_r$ directed transversely to the cable longitudinal extent L onto the corrugated sheath cable 1, as is illustrated in FIG. 4*b*. Here, the clamping/tensioning element 15 including corrugated sheath cable 1 is guided around the bending guide 14 in a force-loaded manner, so that the region of the corrugated sheath cable 1 divested of the cable sheath 5 clings to the surface of the bending guide 14 in the manner illustrated in FIG. 4*b*.

Figure 4C:
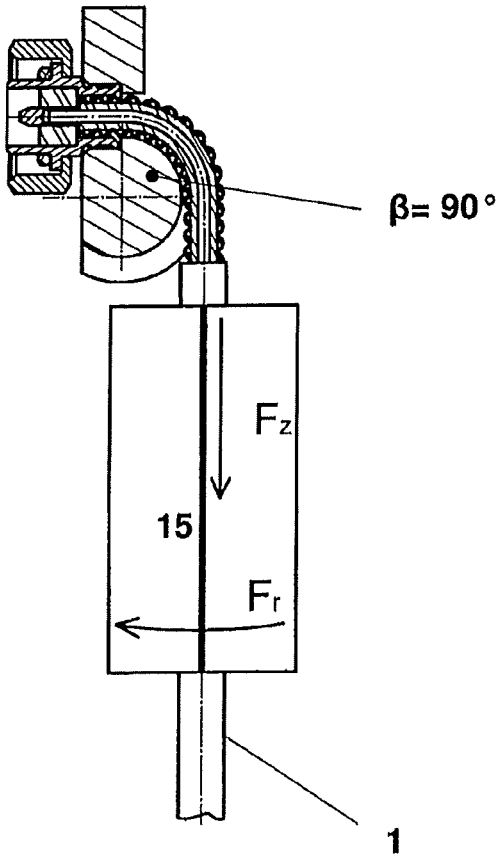

The bending process is ended as soon as the clamping/tensioning element 15 has cold formed the corrugated sheath cable 1 by 90°, as is illustrated in FIG. 4*c*.

The bending guide 14 advantageously has a concavely constructed contact surface, using which the bending guide 14 comes into contact with at least one eighth, preferably up to a half of the circumferential edge of the corrugated cable outer conductor of the corrugated sheath cable 1. The concave construction of the bending guide 14 supports the shape retention of the cross-sectional geometry of the corrugated sheath cable 1 and, connected therewith, the constant electrically effective diameter de during the cold forming process.

The adaptation of the forces $F_z$ and $F_r$ acting on the corrugated sheath cable 1 during the cold forming process is of central importance. In particular, during the choice of the tensile force $F_z$ acting along the corrugated sheath cable 1, it is necessary to note that the inner surfaces 16 and 17 of two corrugated guides (cf. FIG. 2), which directly face the bending guide 14, are spaced apart from one another by a corresponding stretching action and not pressed together by the bending process. On the other hand, the tensile force $F_z$ must not lead to tears or other material degradations forming on the side of the cable outer conductor 2 facing away from the bending guide 14. Thus, the force contribution of the bending process and acting on the corrugated sheath cable, which is composed of the sum of tensile force $F_z$ and bending force $F_r$, is chosen individually in each case as a function of size and material type and also of the material composition of the corrugated sheath cable. The forming on the one hand constitutes a plastic forming, providing the desired, bent spatial form of the corrugated sheath which is retained without further force contribution, and on the other hand does not lead to any of the previously described material degradations.

Figure 5:
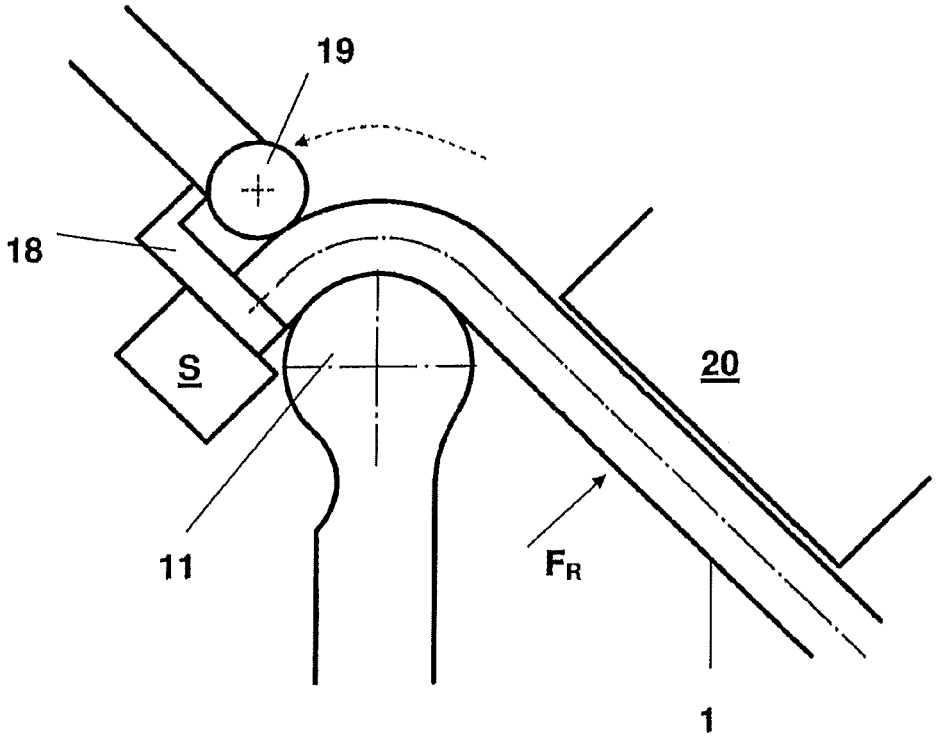
FIG. 5 shows an alternative bending device for a corrugated sheath cable for producing the smallest bending radii.

FIG. 5 shows an alternative bending tool with a stationarily attached bending guide 11, to which a retaining means 18 is pivotably attached, into which the straight plug connector S can be inserted in a fixed manner such that it cannot be released. A rolling or sliding body 19 is provided together with the retaining means 18 attached such that it can pivot about the bending guide 11 to which the rolling or sliding body is attached radially spaced apart from the circumferential edge of the bending guide 11. During the pivoting process, the rolling or sliding body 19 exerts a contact force onto the corrugated sheath cable 1, which is directed orthogonally onto the bending guide 11 which causes the corrugated sheath cable 1 to be cold formed on the basis of the bending contour of the bending guide 11. Along the corrugated sheath cable 1, the corrugated sheath cable 1 is pressed against a likewise stationarily attached guide unit 20 with a retaining force FR. As a result, the corrugated sheath cable 1 experiences a tensile stress orientated along the corrugated sheath cable, which together with the bending force leads to the cold forming according to the invention. In this case also, it is necessary to choose the retaining force $F_R$, by means of which the tensile and bending forces explained in connection with the FIGS. 4*a* to *c* are predetermined, in such a manner that a forming, which is plastic and maintains the corrugated outer contour of the corrugated sheath cable, is achieved, with there being no considerable deformation or material degradations, which influence the HF transmission properties of the bent corrugated sheath cable, occur.

Figure 6:
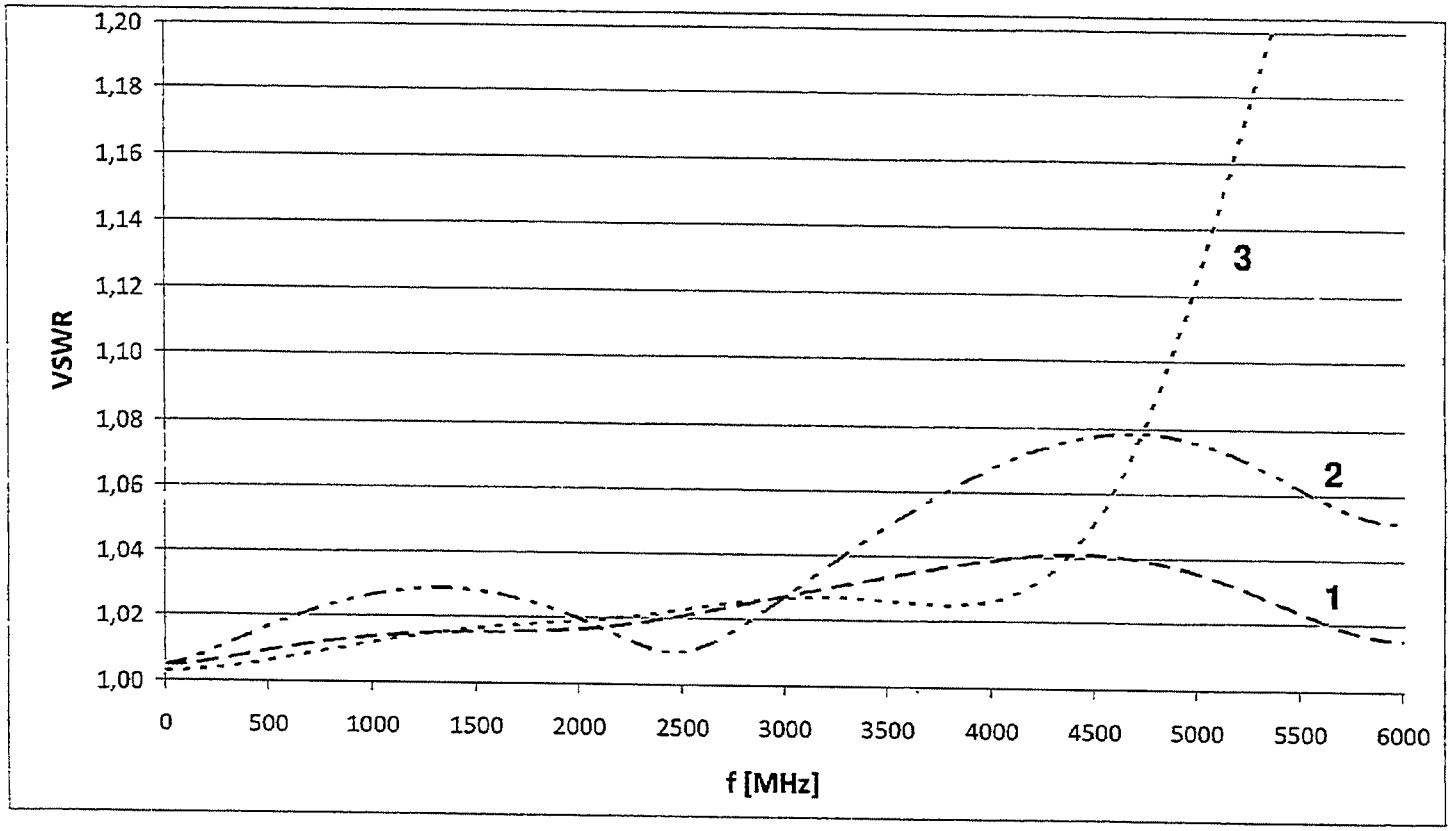
FIG. 6 shows a graph for comparing the standing wave ratio between a straight connection, a bent embodiment according to the invention and a conventional angular plug connection with mountable plug connection.

In FIG. 6 a graph is shown for comparing the standing wave ratio between a straight (Function 1), a corrugated sheath cable bent according to the invention with angular plug connector (Function 2), and a conventionally bent angular plug connection with mountable plug connector (Function 3). The standing wave ratio is a measure for the standing wave, which arises along a waveguide due to reflection. In the case of a standing wave ratio close to the value 1, virtually the entire HF power fed in is transmitted through the transmission line into a load. This is the desired state if the line is used for energy transmission. With increasing values of the standing wave ratio, the reflected portion increases and thus the loss increases. In the illustrated graph, the so-called electrical voltage standing wave ratio (VSWR) is shown along the ordinate as a function of the frequency f of 0 to 6000 MHz, which is entered along the abscissa.

Starting from a straight, unbent corrugated sheath cable, to which a straight connector is attached to feed in a HF signal, VSWR values from close to 1 up to 1.04 maximum are shown. Using a corrugated sheath cable bent according to the invention, VSWR values in the range of 1 and maximum of 1.08 in the specified frequency range of 0 to 6000 MHz can be achieved. By contrast, in the case of a corrugated sheath cable conventionally assembled with an angular plug, a clear increase of the VSWR value is shown at frequencies from approximately 4500 MHz.

In addition, the simple structure of the angular plug connector formed according to the invention opens up, in view of a reduced number of parts, a significant reduction of intermodulation risks that occur definitely in conventionally formed angular plug connectors already due to their complex and multi-component structure.

REFERENCE LIST

1 Corrugated sheath cable
2 Cable outer conductor
3 Cable dielectric
4 Cable inner conductor
41 End of the cable inner conductor
42 Plug inner conductor
5 Cable sheath
51 Cable sheath end for angular plug connection
52 Cable sheath end for straight plug connection
6 Plug external conductor
61 Accommodating sleeve
62 Solder connection
7 Insulating support
8 Union nut
9 Seal
10 Covering
11 Bending guide
12 Retaining means
13 Recess
14 Bending guide
15 Clamping/tensioning element
16 Internal surface of a cable outer conductor corrugated guide
17 Internal surface of a cable outer conductor corrugated guide
18 Retaining means
19 Rolling or sliding body
20 Guide unit
S Plug connector
h Overall height
$F_z$ Tensile force
$F_r$ Bending force
$F_R$ Retaining force

The invention claimed is:

1. A high-frequency (HF) coaxial corrugated cable comprising:

a plug connector located at at least one of two ends, a cable inner conductor, a dielectric layer surrounding and contacting the cable inner conductor and tubular metallic corrugated outer conductor surrounding and contacting the dielectric layer;

a HF corrugated coaxial cable including the tubular metallic corrugated outer conductor which centrally surrounds the cable inner conductor and the dielectric layer, the HF corrugated coaxial cable having characteristic features including line impedance $Z_k$, and a minimum bending radius $r_{k,min}$ specified by a manufacturer;

an end of the HF corrugated coaxial cable providing access to the cable inner conductor, the dielectric layer surrounding and contacting the inner cable conductor and the metallic outer conductor surrounding and contacting the dielectric layer; and wherein the plug connector is connected to one of the cable ends, the cable inner conductor being joined to an inner conductor of the plug connector and the cable metallic corrugated outer conductor is joined with an outer metallic conductor of the plug connector; and the HF corrugated coaxial cable includes a cold formed region and is attached to the plug connector or spaced from the plug connector with a permanent curved bend subtending an angle between 85° and 95° in the corrugated coaxial cable with a radius length $r_\alpha$ extending from a center point to the curved bend of the HF corrugated coaxial cable which provides the line impedance $Z_k$ $r_{k,min}$ with a maximum of less than 1 ohm when $0.2\ r_{k,min} \leq r_\alpha 0.9\ r_{k,min}$.

2. The cable according to claim 1, comprising:

the bend of the HF corrugated cable is coated with a plastic or an adhesive.

3. The cable according to claim 2, comprising:

an electrical diameter of the bend differs no more than 10% from an electrical diameter of a straight region of the HF corrugated coaxial cable.

4. The cable according to claim 3, comprising:

the permanent bend of the HF corrugated coaxial cable has a bending radius $r_\alpha$where $0.4\ r_{k,min} \leq r_\alpha \leq 0.6\ r_{k,min}$, and the HF corrugated coaxial cable is attached to or is spaced from the plug connector.

5. The cable according to claim 1, comprising:

an electrical diameter of the bend differs no more than 10% from an electrical diameter of a straight region of the HF corrugated coaxial cable.

6. The cable according to claim 1, comprising:

the permanent bend of the HF corrugated coaxial cable has a bending radius $r_a$ where $0.4\ r_{k,min} \leq r_\alpha \leq 0.6\ r_{k,min}$, and the HF corrugated coaxial cable is attached to or is spaced from the plug connector.

* * * * *